US005484241A

United States Patent [19]

Haywood et al.

[11] Patent Number: 5,484,241

[45] Date of Patent: Jan. 16, 1996

[54] COLLAPSIBLE VOID FILLER

[75] Inventors: Gerald A. Haywood, Hohenwald; Gregory S. King, Mount Pleasant; Anthony J. Sansone, Franklin, all of Tenn.

[73] Assignee: Shippers Paper Products Company, Glenview, Ill.

[21] Appl. No.: 361,298

[22] Filed: Dec. 22, 1994

[51] Int. Cl.[6] ..... B32B 3/12; B65D 19/34; B61D 45/00

[52] U.S. Cl. ..... 410/154; 108/51.3; 108/53.1; 108/56.1; 206/814; 206/821; 206/460

[58] Field of Search ..... 410/154, 155, 410/121, 156; 108/51.3, 53.1, 53.5, 53.3, 56.1; 229/120.36; 206/386, 814, 821, 598, 415, 416, 460

[56] References Cited

U.S. PATENT DOCUMENTS

| | | | |
|---|---|---|---|
| 2,744,624 | 5/1956 | Hoogstoel et al. | 206/460 X |
| 2,925,947 | 2/1960 | Brown | 108/51.3 X |
| 3,028,981 | 4/1962 | Ford et al. | 214/10.5 |
| 3,079,876 | 3/1963 | Doane | 108/56 |
| 3,079,877 | 3/1963 | Doane | 108/56 |
| 3,273,518 | 9/1966 | Shina | 108/51.3 |
| 3,308,772 | 3/1967 | Thomas, Jr. | 108/51.3 |
| 3,469,542 | 9/1969 | Ahlenius | 108/56.1 |
| 4,247,237 | 1/1981 | Brown | 410/154 |
| 4,363,579 | 12/1982 | Rogers | 410/154 |
| 4,372,717 | 2/1983 | Sewell et al. | 410/154 |
| 4,399,972 | 8/1983 | McCulloch | 108/51.3 X |
| 4,467,728 | 8/1984 | Horne | 108/51.3 X |
| 4,494,897 | 1/1985 | Rogers | 410/154 |
| 4,502,597 | 3/1985 | Cantey | 108/51.3 X |
| 4,516,891 | 5/1985 | Wnuk et al. | 410/154 |
| 4,585,381 | 4/1986 | Boyse | 410/154 |
| 4,865,889 | 9/1989 | Boyse | 428/12 |
| 4,936,229 | 6/1990 | Parnell | 108/51.3 |
| 5,000,376 | 3/1991 | Wojdyla | 229/120.11 |
| 5,062,751 | 11/1991 | Liebel | 410/154 |
| 5,102,272 | 4/1992 | Woods et al. | 410/154 |
| 5,132,156 | 7/1992 | Trassare, Jr. et al. | 428/116 |

FOREIGN PATENT DOCUMENTS

| | | | |
|---|---|---|---|
| 878255 | 8/1971 | Canada | 105/182 |
| 2733213 | 2/1979 | Germany | 206/460 |
| 2837659 | 3/1980 | Germany | 206/460 |
| 5-85566 | 4/1993 | Japan | 206/460 |

OTHER PUBLICATIONS

Wrapping Systems Publication 1988 Shippers Paper Products Co.

*Primary Examiner*—Michael S. Huppert
*Assistant Examiner*—Stephen Gordon
*Attorney, Agent, or Firm*—Schwartz & Weinrieb

[57] ABSTRACT

A void filler device for use in staggering paper rolls during shipment includes a housing member which generally surrounds an inner core. The housing member has a top wall, a bottom wall, and side walls which are attached to the core, and is octagonally shaped. The top and bottom walls of the housing include fold lines around which the walls are folded to collapse the void filler device. The inner core member includes a plurality of flat boards made of laminated paperboard, corrugated cardboard, plastic or other like suitable material. Each of the boards has spaced notches along its length and the boards are interconnected with each other along the notches to form an open cell construction that is expandable and collapsible. The top and bottom walls can include apertures therein for ensuring that the paper rolls are properly aligned.

16 Claims, 2 Drawing Sheets

COLLAPSIBLE VOID FILLER

FIELD OF THE INVENTION

This invention is generally directed to a void filler which is used to stagger paper rolls during shipment. More specifically, this disclosure is directed toward a void filler which may be expanded into a rigid configuration for use in filling spaces or collapsed into a generally flat configuration for storage or for shipment to a user.

BACKGROUND OF THE INVENTION

The use of void fillers is well-known in the art. For example, U.S. Pat. No. 4,865,889 to Boyse discloses an open-celled void filler that is comprised of a honeycomb core surrounded by deck sheets. The ends of the deck sheets are secured to the ends of the honeycomb core and include integrally formed score indentations in the deck sheet along the edges of the core and along the midpoint of the deck sheets. The void filler collapses around the fold lines and the honeycomb core collapses therewithin. The void filler may be moved from a collapsed configuration to an expanded configuration by pulling the opposing ends of the deck sheets which are secured to the core away from each other until the sides of the deck sheets generally abut the core.

While this type of void filler has worked effectively in prior applications, it seems to collapse easily due to the natural tendencies of the honeycomb core to collapse and of the score indentations which tend to urge the deck sheets of the void filler outwardly. Furthermore, the honeycomb core is costly and difficult to manufacture.

The present invention is intended to overcome or minimize all of these problems, as well as to present several other improvements.

SUMMARY OF THE INVENTION

A general object of the present invention is to provide a novel void filler which is used to stagger paper rolls during shipment.

An object of the present invention is to provide a novel void filler which can collapse for shipment to a user or for storage while occupying a relatively small amount of space and then be expanded by a user for use.

It is another object of the present invention to provide a novel core for a void filler which provides resistance to crushing and distortion by a load.

A further object of the present invention to provide a novel void filler that is lightweight, rigid and strong.

A specific object of the present invention is to provide a void filler which can be expanded with ease by a user with no specialized training.

Briefly, and in accordance with the foregoing, the present invention discloses a collapsible void filler device which is foldable into a generally flat, collapsed configuration for storage or shipment to a user and unfoldable into an expanded configuration for use in staggering paper rolls during transit or shipment. The void filler has an outer housing that generally surrounds a collapsible core. The housing includes a bottom wall, a top wall, and two side walls. The top and bottom walls have fold lines thereon that urge the walls outwardly so that the housing can collapse.

The collapsible core includes a plurality of flat boards members or sheets preferably of laminated paperboard available from Shippers Paper Products the assignee of this patent application, under the trademark ANGLEBOARD® or other suitable material including plastic. Each of the boards has spaced notches along its length and the boards are interconnected with each other along the notches to form an open cell construction that is expandable and collapsible. Each board has a width which is sized so as to contact and space apart the top and bottom walls to prevent inward movement of the walls and to thereby rigidify the housing when the void filler is disposed in an expanded configuration.

The top and bottom walls can include an aperture thereon for ensuring that the paper rolls are properly aligned. Furthermore, the top wall and/or the bottom wall may include strips of double sided adhesive on the outer side of the walls to hold or stick the void filler on the paper roll.

BRIEF DESCRIPTION OF THE DRAWINGS

The organization and manner of the structure and operation of the invention, together with further objects and advantages thereof, may best be understood by reference to the following description, taken in connection with the accompanying drawings in which similar reference characters designate like or corresponding parts throughout the several views, and wherein.

DETAILED DESCRIPTION OF THE PREFERRED EMBODIMENT

Figure 1:
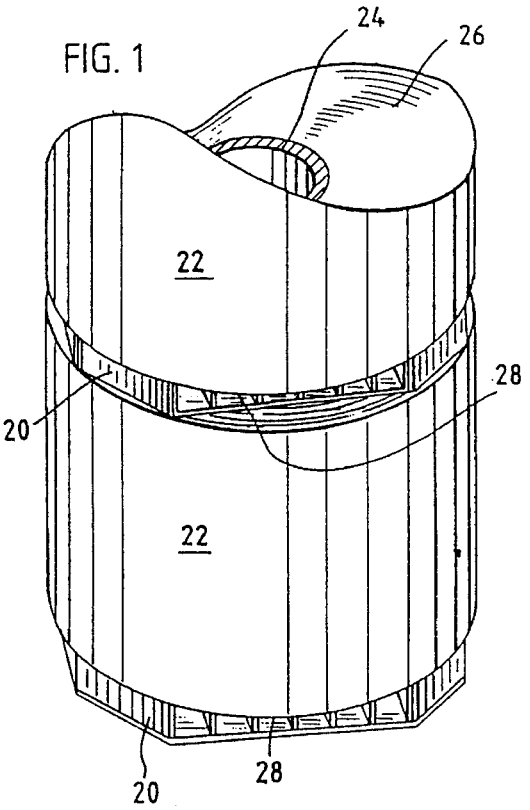
FIG. 1 is a perspective view of two void fillers which incorporate features of a first embodiment of the present invention and are shown supporting paper rolls.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the drawings, void fillers 20, **20*a* which incorporate features of the present invention are illustrated. A first embodiment of the void filler 20 is shown in FIGS. 2 and 4–8. A second embodiment of the void filler 20*a* is shown in FIG. 9**.

The void fillers 20, **20*a* of the present invention are used to fill empty spaces between pieces of cargo during transit or shipment. They may be used in a variety of shipping applications, such as a truck trailer, a ship or an airplane cargo bay. The void fillers 20, 20*a* may have a variety of sizes. In use, the void fillers 20, 20***a* can be collapsed for shipment to a user or for storage while occupying a relatively small amount of space, and then expanded by the user for use during shipment or transit.

Figure 9:
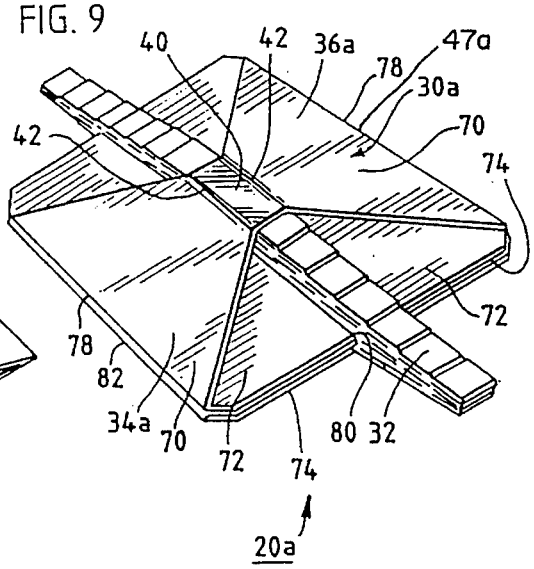
FIG. 9 is a perspective view of a second embodiment of a void filler which incorporates features of the present invention and which is shown in a collapsed configuration.

As shown in FIGS. 1 and 9, the void fillers 20, 20*a* of the present invention are preferably used to stagger paper rolls 22. The paper rolls 22 are of a known construction and as such will only be described briefly herein. Each paper roll 22 is cylindrically shaped and has a cylindrical, hollow core 24 in the center. The paper 26 is wrapped around the core 24. The ends 28 of the paper roll 22 have a circular profile.

The void filler 20 is described first. Thereafter, the differences between the first embodiment of the void filler 20 and the second embodiment of the void filler 20*a* are described. Like elements or features of the embodiments are denoted by like reference numerals. Similar elements or features of the embodiments as described herein are denoted by similar reference numerals with the exception that the elements or features of the second embodiment shown in FIG. 9 include the suffix "a" after the numeral.

Figure 2:
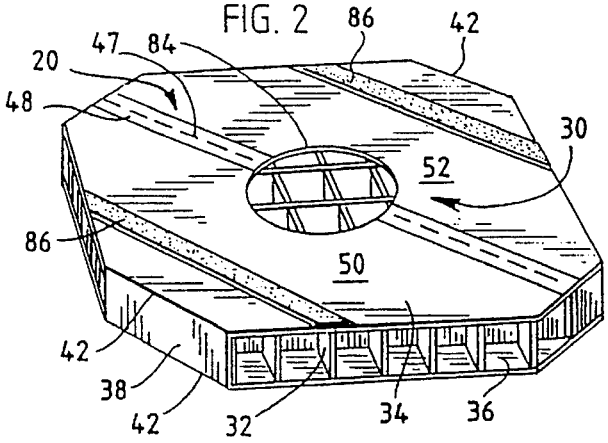
FIG. 2 is the perspective view of a void filler of FIG. 1 according to the first embodiment of the present invention.
Figure 5:
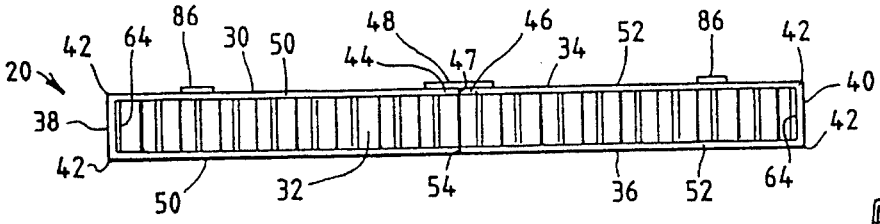
FIG. 5 is an elevational view of the void filler of FIG. 2.
Figure 6:
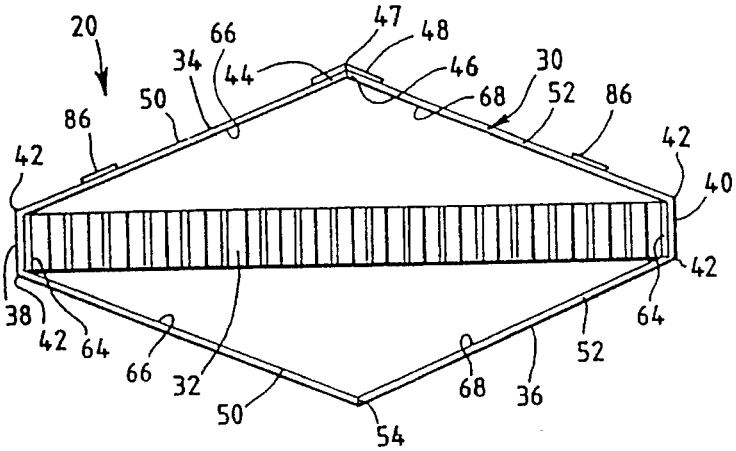
FIG. 6 is an elevational view of the void filler of FIG. 2 shown in a partially collapsed configuration.
Figure 7:
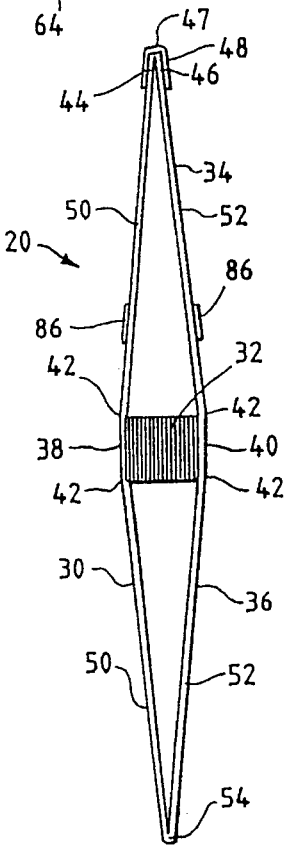
FIG. 7 is an elevational view of the void filler of FIG. 2 shown in a collapsed configuration.
Figure 8:
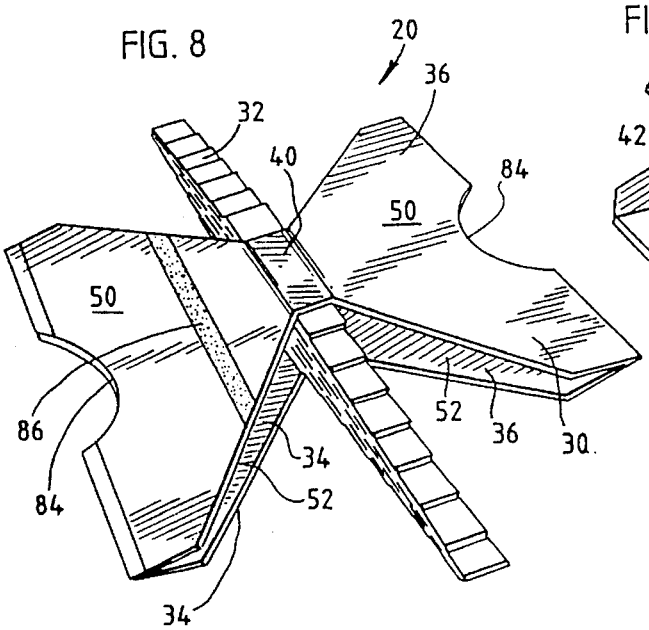
FIG. 8 is a perspective view of the void filler of FIG. 2 shown in a collapsed configuration.

The void filler 20 includes an outer housing member 30 which surrounds a reinforcing and strengthening inner core member 32. As shown in FIGS. 7 and 8, the void filler 20 is collapsible into a generally flat, collapsed configuration. When the void filler 20 is in this generally flat configuration, the void filler 20 does not occupy a large volume of space while stored or being shipped to a user. In use, when the void filler 20 is expanded, as shown in FIGS. 2 and 5, the rigid void filler 20 is placed between paper rolls 22 or between a paper roll 22 and a structure, such as a floor, and prevents damage to the paper rolls 22 during transit or shipment.

The housing member 30 includes a top wall 34, a bottom wall 36 and two side walls 38, 40. The housing member 30 may be constructed from a single sheet of material which is folded around the core slab or member 32 about scored or weakened fold lines 42 to create the walls 34, 36, 38, 40. The sheet is made of a suitable material, preferably laminated paperboard available under the trademark ANGLEBOARD® from Shippers Paper Products, corrugated cardboard, plastic and the like. The housing member 30 generally encloses the core member 32 therewithin.

The ends 44, 46 of the sheet are joined at a juncture 47 along a wall of the housing member 30, shown as the top wall 34 in the drawings, by suitable means, such as adhesive, glue or the like. As shown, the ends 44, 46 of the sheet are joined at the juncture 47 by a strip of tape 48. It is to be understood that the ends 44, 46 of the sheet may overlap. It is also to be understood that more than one sheet may be used to form the housing member 30 with the sheets being attached to each other by suitable means, such as tape, adhesive, glue or the like. Further, the juncture 47 where the ends 44, 46 of the sheet meet may be along some other point of the housing member 30 than the point shown in the drawings.

In the first embodiment of the void filler 20, as shown in FIGS. 2 and 5–7, the top wall 34 and the bottom wall 36 are divided at approximately their midpoints into a first portion 50 and a second portion 52. As shown, the top wall 34 is divided at the juncture 47 where the ends 44, 46 of the sheet meet. The bottom wall 36 is divided by a scored or weakened fold line 54 which extends across the length of the bottom wall 36.

The fold lines 42, 54 in the void filler 20 may be formed by a scoring bead or an integrally formed score indentation. The score may be applied by any well known method, such as an automatic roller or a manual device, and is intended not to pierce, cut or otherwise weaken the material but instead act to create a force which urges the top and bottom walls outwardly to collapse the housing member 30 into a flattened configuration. The score allows the top and bottom walls 34, 36 to be easily folded outwardly by a user when it is necessary to collapse the void filler 20 into a collapsed configuration for storage or shipment to a user as described hereinbelow.

To collapse the void filler 20, the bottom wall 36 is easily folded outwardly along the fold line 54. The top wall 34 is easily folded outwardly along the juncture 47 where the ends 44, 46 of the sheet meet. It is to be understood that the top wall 34 may include a fold line identical to the fold line 54 along the midpoint of the bottom wall 36 with the ends 44, 46 of the sheet meeting at some other point along the perimeter of the housing member 30.

Figure 3:
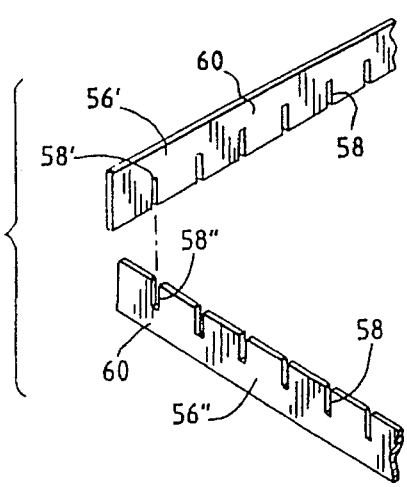
FIG. 3 is a partial perspective view of two boards of the core used in the void filler of the present invention.
Figure 4:
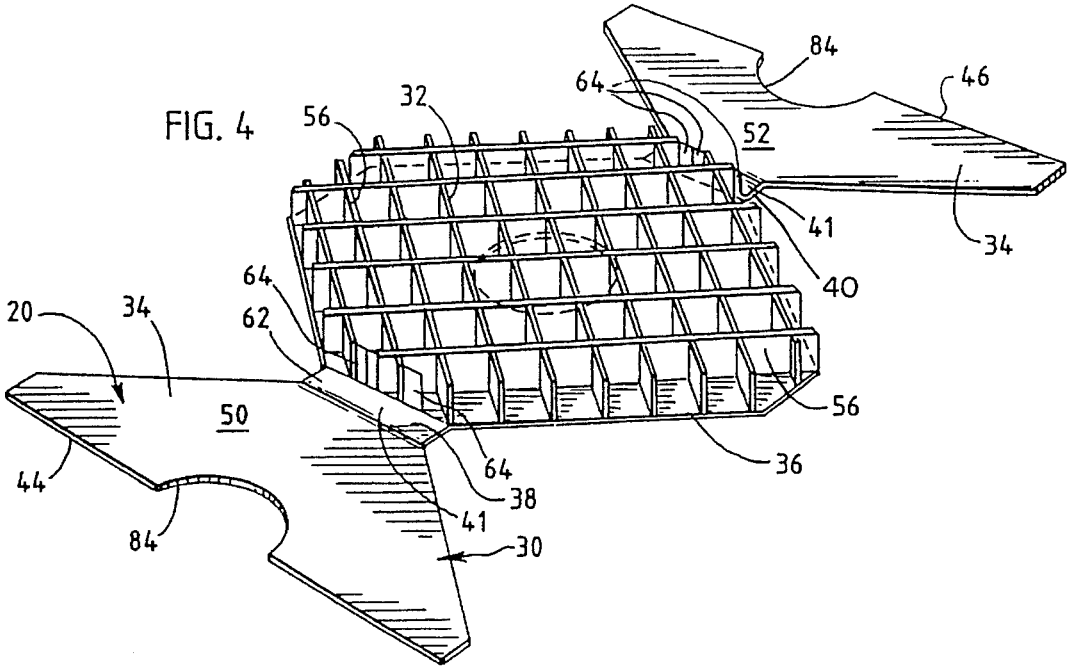
FIG. 4 is a perspective view of the void filler of FIG. 2 with the core exposed.

As shown more clearly in FIGS. 3 and 4, the core slab or member 32 includes a plurality of interlocking and interconnecting board members 56. Each board member 56 is generally flat and elongate, having a length and a width. The width of each of the board members 56 is substantially the same as the width or height of the side or end walls 38 and 40 so that when the void filler 20 is fully expanded, the board members 56 contact and space apart the top wall 34 and the bottom wall 36 of the housing member 30 so as to prevent inward movement of the top and bottom walls 34, 36 and thereby rigidify the housing member 30.

Each board member 56 is made of a suitable rigid material, preferably laminated paperboard. The paperboard provides the void filler 20 with rigidity and strength so the void filler 20 can support the load created by the paper rolls 22. Furthermore, since paperboard or corrugated cardboard and the like are used in the void filler construction, the void filler 20 is lightweight.

Each board member 56 includes a plurality of slots or notches 58 which are spaced apart along its length and each of which lie adjacent to an unnotched portion 60. Each slot or notch 58 extends approximately half of the width of the board member 56 and is approximately the same width as the thickness of the board member 56.

As shown in FIG. 3, the board members 56 are interlocked or interconnected with each other by aligning the notches 58 along the board members with notches along the other board members and pushing the board members together until the edges of the board members lie flush with one another. For example, as shown in FIG. 3, the board members 56', 56" are interlocked or interconnected by aligning the notches 58' along the board member 56' with notches 58" along the board member 56" and pushing the board members 56', 56" together until the edges of the board members 56', 56" lie flush with one another as shown in FIG. 4. Since the width of the notch 58 is approximately the same as the thickness of the board member 56, the unnotched portion 60 of the board member 56 is trapped within the notch 58 and the board members 56 remain interlocked and interconnected with each other.

Once all of the board members 56 are interlocked and interconnected with each other, as shown in FIG. 4, an open-celled core slab or member 32 is formed which is expandable and collapsible. The board members 56, as described hereinbelow, can pivot relative to one another in order to allow the core member 32 to collapse.

The housing member 30 generally surrounds the core member 32 to form a sandwich-type construction so as to increase the strength of the void filler 20 when it is in an expanded configuration. The sandwich-type construction helps to prevent the void filler 20 from collapsing under the load of the paper rolls during shipment or transit and provides resistance to crushing and distortion by a load, such as the paper rolls 22.

Each of the side walls 38, 40 of the housing member 30 have an inner side 62 which is secured to portions 64 of the core member 32 by suitable means, such as a layer of adhesive 41. The portions 64 of the core member 32 may be folded to form a flap so that they lie parallel to the side walls 38, 40 to provide a wider surface along which the side walls 38, 40 can be secured to the core member 32. The top and bottom walls 34, 36 of the void filler 20 are freely movable towards and away from the core member 32 as described hereinbelow.

When the void filler 20 is in its collapsed, reduced volume configuration, as shown in FIGS. 7 and 8, the core member 32 is generally flat. To collapse the void filler 20, as shown in FIGS. 4–7, a user need only apply light hand pressure to the side walls 38, 40 of the housing member 30 in an inward direction. The housing member 30 collapses along the score indentations 42, 54 and the juncture 47. The top and bottom walls 34, 36 fold outwardly until the inner sides 66, 68 of each of the respective first portion 50 and second portion 52 generally abut each other. The board members 56 move relative to each other by the unnotched portions 60 pivoting relative to the notches 58 to collapse the core member 32.

The second embodiment of the void filler **20*a* shown in FIG. 9, is similar to the void filler 20 of the first embodiment except that the top wall 34*a* and bottom wall 36*a* are divided into a first portion 70, a second portion 72, a third portion 74 and a fourth portion (not shown). The first and second portions 70, 72 are divided by a first fold line 78. On the bottom wall, the second and third portions 72, 74 are divided by a second fold line 80. On the top wall, the second and third portions 72, 74 are divided by the juncture 47 where the ends 44, 46 meet. The third portion 74 and the fourth portion are divided by a third fold line 82. The fold lines 78, 80, 82 may be formed by a scoring bead or an integrally formed score indentation in a manner identical to that of the first embodiment. It is to be understood that the top wall 34*a* may include a fold line identical to the second fold line 80 along the midpoint of the bottom wall 36 with the ends 44, 46 of the sheet meeting at some other point along the perimeter of the housing member 30*a***.

The first and third fold lines 78, 82 act to create a force which urges the top and bottom walls **34*a*, 36*a* outwardly. The second score line 80 and the juncture 47 act to create a force which urges the top and bottom walls 34*a*, 36*a* inwardly. The combination of the three score lines 78, 80, 82 and the juncture 47 act to collapse the housing member 30*a* into a flattened configuration as shown in FIG. 9. The score lines 78, 80, 82 and the juncture 47 allow the top and bottom walls 34*a*, 36*a* to be easily folded by a user when it is necessary to collapse the void filler 20*a*** for storage as described hereinbelow.

The second embodiment of the void filler **20*a* collapses in a similar manner to the void filler 20 of the first embodiment. When the void filler 20*a* is in its collapsed, reduced volume configuration, as shown in FIG. 9, the core member 32 is generally flat. To collapse the void filler 20*a*, a user need only apply light hand pressure to the side walls 38, 40 of the housing member 30*a* in an inward direction. The housing member 30*a* collapses along the fold lines 78, 80, 82 and the juncture 47 and the top and bottom walls 34*a*, 36*a* fold with the inner sides of the respective first and second portions 70, 72 and the respective third portion 74 and fourth portion generally abutting each other and the outer sides of the respective second and third portions 72, 74 generally abutting each other. The board members 56 of the core slab or member 32 move relative to each other by the unnotched portions 60 pivoting within the notches 58 to collapse the core member 32**.

To expand the first and second embodiments of the void fillers **20, 20*a*, the side walls 38, 40 are pulled away from each other. The top and bottom walls 34, 36; 34*a*, 36*a* move inwardly until they abut the sides of the core slab or member 32. The board members 56 pivot relative to each other by the unnotched portions 60 pivoting within the notches 58. When the void fillers 20, 20*a* are expanded to their increased volume configurations, the core member 32 is expanded to an open-celled configuration. The open-celled configuration is best illustrated in FIG. 4**.

When the void fillers **20, 20*a* are in their expanded configuration, the top and bottom walls 34, 36; 34*a*, 36*a* generally abut the sides of the core member 32 but are freely movable away from the core member 32. The top and bottom walls 34, 36; 34*a*, 36*a* of the housing member 30, 30*a* are parallel to each other. The side walls 38, 40 and top wall 34, 34*a* of the housing member 30, 30*a* are at approximately a 90° angle relative to each other and the side walls 38, 40 and the bottom wall 36, 36*a* of the housing member 30, 30*a*** are at approximately a 90° relative to each other.

The below described features and advantages are in reference to the first embodiment of the void filler 20. It is to be understood that the below described features and advantages are equally applicable to the second embodiment of the void filler **20*a***.

Since the void filler 20 is generally flat, the void filler 20 does not occupy a large amount of space when it is being shipped to a user or stored. Furthermore, multiple void fillers 20 may be stacked on top of each other for shipment to the user or for storage.

In use, the void filler 20 is placed against a paper roll 22 or between paper rolls 22 with the top wall 34 or bottom wall 36 of the housing member 30 abutting the paper roll 22. The forces created by the load of the paper rolls 22 during transport or shipment are resisted by the void filler 20 so the paper rolls 22 are stabilized during shipment.

The top wall 34 and bottom wall 36, as shown in the drawings, are octagonally-shaped. Since the void filler 20 of the present invention is usually used to support large, cylindrically-shaped paper rolls 22 with circular end profiles 28, the octagonal shape closely conforms to the circular end profile 28 while minimizing the amount of material which is used to make the void filler 20. While the octagonal shape is the preferred embodiment, it is to be understood that other shapes, such as a square or a rectangle, may be used, especially when the void filler 20 is used to support structures other than paper rolls 22.

One feature of note is that the top wall 34 and the bottom wall 36 of the housing member 30 may include an aperture 84 therein in the center of each wall. The aperture 84 is preferably the same size as the hole in the core 24 of the paper roll 22. The aperture 84 allows a user to easily locate and position the paper roll 22 centrally on the void filler 20. When the paper roll 22 is properly centered on the void filler 20, the hole in the core 24 of the paper roll 22 and the apertures 84 in the void filler 20 are aligned. Thus, when a user looks down through the hole in the paper roll 22, the user will be able to look directly through the open cells of the core member 32 of the void filler 20.

An additional feature of note is that the wall, for example the top wall 34 shown in FIG. 2, of the void filler 20 which contacts the end 28 of the paper roll 22 may include strips of adhesive 86, such as double-sided tape. When the paper roll 22 is properly aligned with the void filler 20, the user can press the paper roll 22 against the void filler 20 so that the paper roll 22 sticks to the void filler 20. This aids in securing the void filler 20 to the paper roll 22. The second embodiment of the void filler 20*a* may include strips of double sided tape on a wall thereof for the reason set forth herein.

The void filler 20 of the present invention can be assembled and disassembled easily and quickly. Thus, no specialized training is necessary. Furthermore, the void filler 20 is reusable.

While embodiments of the present invention are shown and described, it is envisioned that those skilled in the art may devise various modifications of the present invention without departing from the spirit and scope of the invention as set forth in the appended claims. The invention is not intended to be limited by the foregoing disclosure.

We claim:

1. A void filler device, capable of being expanded from a collapsed configuration to an expanded configuration, and collapsed from said expanded configuration to said collapsed configuration, comprising:

an inner core member having a substantially parallelepiped configuration comprising four sides and four corners;

a housing member substantially surrounding said inner core member, and comprising a top wall, a bottom wall, and a pair of side walls attached to a first pair of opposite ones of said four corners of said inner core member;

said inner core member comprising a plurality of interlocking members wherein each one of said interlocking members has a depth dimension which is sized so as to contact and space apart said top and bottom walls of said housing member so as to restrict inward movement of said top and bottom walls and thereby rigidify said void filler when said void filler device is disposed in said expanded configuration; and first fold line means, defined between said top wall and said pair of side walls, and between said bottom wall and said pair of side walls, for permitting said top and bottom walls to be folded with respect to said side walls when said void filler device is alternatively expanded and collapsed between said collapsed and expanded configurations as a result of said first pair of said four corners of said core member moving toward and away from each other, and second fold line means, defined within both of said top and bottom walls and extending across said top and bottom walls between a second pair of opposite ones of said four corners of said inner core member, for permitting said top and bottom walls of said housing member to move outwardly away from said inner core member and inwardly toward said inner core member when said void filler device is alternatively collapsed and expanded between said collapsed and expanded configurations.

2. A void filler device as defined in claim 1, wherein said interlocking members include a plurality of interconnected board members which form an open cell construction that is expandable and collapsible.

3. A void filler device as defined in claim 2, wherein each of said board members includes a plurality of spaced notches, said board members interlocking with each other along said notches to form said open cell construction.

4. A void filler device as defined in claim 3, wherein each of said notches extends approximately half of the depth of each one of said board members, and said core member collapses by said board members moving relative to each other.

5. A void filler device as defined in claim 2, wherein said board members are made of laminated paperboard.

6. A void filler device as defined in claim 2, wherein said board members are made of plastic.

7. A void filler device as defined in claim 1, wherein each of said top wall and said bottom wall have an aperture therein, said apertures being aligned with each other.

8. A void filler device as defined in claim 7, further including an adhesive strip on the outside of at least one of said top or bottom walls for holding a member supported on said void filler device.

9. A void filler device as defined in claim 1, wherein said top wall and said bottom wall are octagonally shaped.

10. A void filler device as defined in claim 9, wherein each of said top wall and said bottom wall have an aperture therein, said apertures being aligned with each other.

11. A void filler device as defined in claim 1, wherein:

said second fold line means includes means for dividing said top and bottom walls of said housing member into two portions, each one of said top and bottom walls of said housing member collapsing along said dividing means when said void filler device is collapsed.

12. A void filler device as defined in claim 11, wherein:

said dividing means includes a single fold line extending across each one of said top and bottom walls of said housing member and between said second pair of opposite ones of said four corners of said inner core member.

13. A void filler device as defined in claim 1, further comprising:

means for dividing said top and bottom walls of said housing member into four portions, each one of said top and bottom walls of said housing member collapsing along said dividing means when said void filler device is collapsed.

14. A void filler device as defined in claim 13, wherein said dividing means includes fold lines.

15. The void filler device as set forth in claim 1, further comprising:

adhesive means for attaching said pair of side walls to said first pair of corners of said inner core member.

16. The void filler device as set forth in claim 1, wherein:

said first and second fold line means comprise scored indentations.

* * * * *